United States Patent [19]

Danta et al.

[11] Patent Number: 4,515,105

[45] Date of Patent: May 7, 1985

[54] DIELECTRIC POWDER SPRAYER

[76] Inventors: William E. Danta, 10440 S. Mason St., Oak Lawn, Ill. 60453; Frank H. Adams, 8014 S. Talman Ave., Chicago, Ill. 60652

[21] Appl. No.: 449,572

[22] Filed: Dec. 14, 1982

[51] Int. Cl.[3] ..... B05B 5/02; B05C 5/02; F23D 11/32

[52] U.S. Cl. ..... 118/629; 101/416 B; 118/630; 239/690; 239/707

[58] Field of Search ..... 204/290 R; 138/103; 361/214, 221, 226; 118/626, 627, 628, 636, 640, 300, 629, 630; 428/379, 458; 101/416 B; 239/690, 706, 707

[56] References Cited

U.S. PATENT DOCUMENTS

| | | | |
|---|---|---|---|
| 3,676,194 | 7/1972 | Probst | 118/626 X |
| 4,101,395 | 7/1978 | Motani et al. | 204/290 R |
| 4,287,139 | 9/1981 | Guignard | 118/626 X |
| 4,297,385 | 10/1981 | Banucci et al. | 427/27 |
| 4,369,104 | 1/1983 | Beckley | 204/290 R X |

*Primary Examiner*—Michael R. Lusignan
*Attorney, Agent, or Firm*—Hill, Van Santen, Steadman & Simpson

[57] ABSTRACT

A plastics material covered metal electrode maintains an electrostatic field dissipating the particles of fine dry powdered dielectric material such as flour or starch to create a cloud or dry mist of the powder in the path of freshly inked sheets as they are discharged from a printing press to prevent smudging of the ink and sticking together of the successive sheets as they are stacked. The electrostatic field is formed across the path of the powder as it is discharged from a supply trough by energizing the electrode with a high voltage current. The plastic covered electrode replaces heretofore required neon gas filled glass tubes which are fragile and burn out. The preferred plastic covering for the electrode is a thermoplastic polyetherimide resin marketed under the name of "Ultem" by General Electric Company of Pittsfield, Mass.

5 Claims, 5 Drawing Figures

DIELECTRIC POWDER SPRAYER

BACKGROUND OF THE INVENTION

1. Field of the Invention

This invention relates to the art of electrostatic spraying of dry powders and particularly relates to electrodes for dry powder misters used in printing presses.

2. Prior Art

Printing presses of the sheet-fed type which rapidly discharge printed sheets into a stack have been equipped with sprayers or misters forming a cloud of dry dielectric powder in the path of the discharging freshly printed sheets to prevent the sheets from sticking together and smudging of the ink. These sprayers or misters have required a gas filled fluorescent light glass tube conventionally known as a neon fluorescent light. These neon light glass tubes were energized with a high voltage current creating an electrostatic field across the path of dry dielectric powder as it descends from a supply source. The tubes were fragile, had a very short life, quickly breaking down under the high voltage and creating an arcing short circuit.

It would therefore be an improvement in this art to replace the neon glass tube electrodes with gas free unbreakable electrodes which do not break, wear or burn out.

SUMMARY OF THIS INVENTION

This invention now provides dry powder sprayers or misters for printing presses and the like having plastic covered metal electrodes creating an electrostatic field to dissipate the particles of fine powdered dielectric absorbent material, such as flour or starch, into a cloud or dry mist through which the freshly printed sheets pass from the press to a stack. The electrodes of this invention replace heretofore required gas filled fluorescent light glass tubes, and are easily mounted on existing dielectric powder spray devices in place of the glass tubes.

Some of the heretofore required glass tubes only had a wear life of about the three months on a printing press operating about 40 hours per week. The electrodes of this invention do not burn out and provide a constant electrostatic field.

Specifically, the electrodes of this invention have a core composed of a solid rod or hollow tube of electrically conductive material, such as steel, copper, aluminum, and the like. The core is covered with a sleeve or coating of a plastic material having a high dielectric strength, a good dielectric constant, high arc resistance, a resistivity allowing passage of current to establish the electrostatic field without arcing or burning a hole through the material, a very low flammability, a good tensile strength, and do not release toxic fumes in the event of a fire.

While many plastics materials have some of the above mentioned properties, it has been found that polyetherimides possess all of the desired properties without any short falls. A very suitable polyetherimide is an amorphous thermo-plastic resin sold under the name of "Ultem" by General Electric Company, Plastics Division, Pittsfield, Mass.

"Ultem" has an excellent dielectric strength of 620 volts/mil at 1/16 inch, a dielectric constant of 3.15, an arc resistance of 128 seconds, a resistivity of $6.7\times10^{17}$, a high flame resistance with a limiting oxygen index of 47, a tensile strength at yield of over 15,000 psi with a high retention of this strength at elevated temperatures, and does not produce toxic fumes when burned.

Other suitable plastic materials, although lacking some of the above properties but retaining a high dielectric constant and a high arc resistance, are polycarbonates such as "Lexan" manufactured by General Electric Company, Pittsfield, Mass., and polysulfones such as "Parylene" manufactured by Union Carbide Co., San Diego. Calif.

The electrodes for dry powder misters or sprayers are commonly referred to as "oxidizer" tubes and it is therefore an object of this invention to provide so-called "oxidizer" tubes for dielectric powder sprayers or misters which eliminate the heretofore required gas and glass by providing a non-breakable current conducting core surrounded by a plastics material covering having a high dielectric strength, high arc resistance, and a high dielectric constant.

Another object of this invention is to provide electrodes for dry powder sprayers composed of a metal core and a surrounding covering of polyetherimide resin.

A specific object of this invention is to provide an electrode for dry powder sprayer apparatus composed of an elongated metal core having a connector at one end for connection to a source of high voltage current, and a sheath of high dielectric strength resin therearound in intimate engagement therewith.

Another object of this invention is to provide an electrode for misters and the like having a core of metal tubing about ½ inch in diameter, an intimate sheath of polyetherimide resin therearound about 1/16 inch thick, and an electrical connector on one end of the core.

Other and further objects of this invention will become apparent to those skilled in this art from the following detailed description of the annexed sheet of drawings which, by way of a preferred example, illustrate one embodiment of this invention.

AS SHOWN ON THE DRAWINGS

Figure 1:
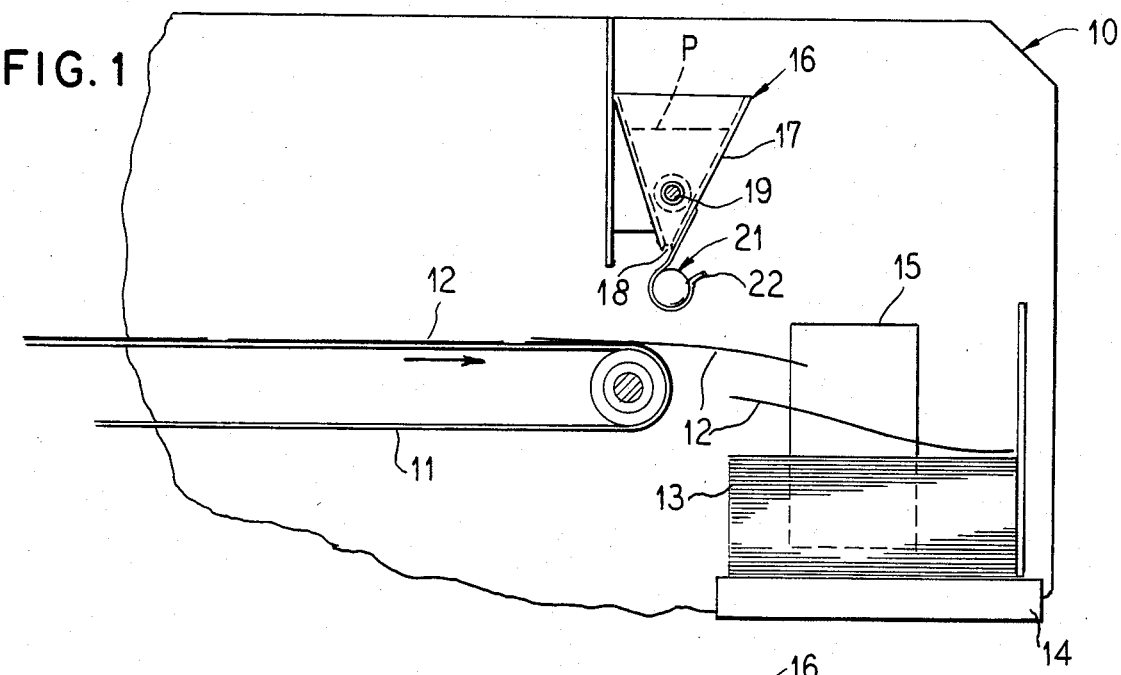
FIG. 1 is a diagrammatic view of the discharge end of a sheet-fed printing press with a dry powder sprayer equipped with an electrode of this invention.

In FIG. 1, the reference numeral 10 designates generally the discharge end of a sheet-fed printing press of the type having conveyor belts or tapes 11 rapidly discharging flat freshly printed sheets 12 between side frames. These sheets descend to form a stack 13 on a platform 14 with a "jogger" 15 aligning the sheets into stacks of desired height.

A sprayer 16 is mounted on a cross frame of the press 10 extending above and across the path of the discharging sheets 12.

The sprayer 16 has an elongated trough 17 with a narrow discharge slot 18 along the bottom thereof. A feeder screw rod 19 is rotatably mounted in the bottom of the trough above the slot 18 and is driven by an electric motor 20 at a speed controlled from a manually set reostat 20*a* feeding a desired amount of dry dielectric powder such as flour, corn starch, and the like through the open bottom slot 18.

An "oxidizer" tube or electrode 21 of this invention is removably mounted in spring "C" clamps 22 carried by the trough 17 adjacent the open slot bottom 18. A gap "G" is provided between the trough and electrode.

Figure 2:
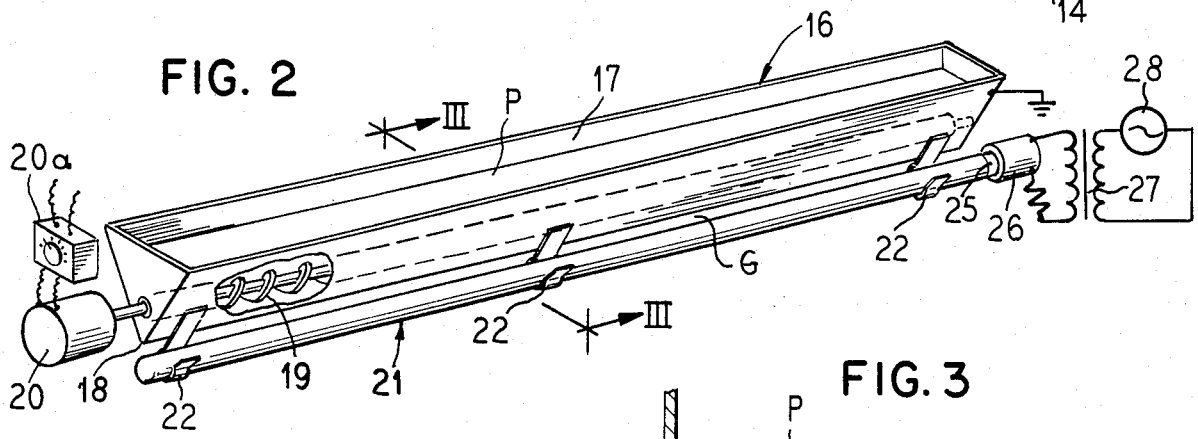
FIG. 2 is a somewhat diagrammatic perspective view of the sprayer and electrode of this invention and showing a high voltage circuit and a motor drive for the sprayer.
Figure 3:
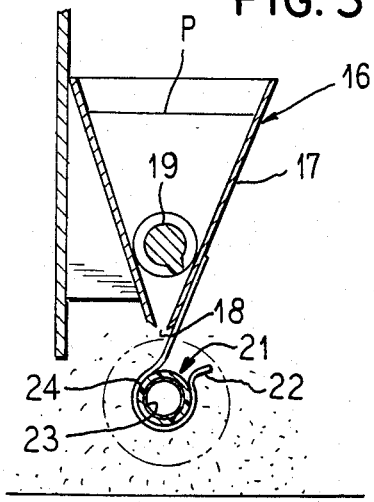
FIG. 3 is a cross-sectional view along the line III—III of FIG. 2.

The electrode 21 has a metal core 23 about ½ inch in diameter and a length equal to or greater than the length of the slot 18. This core 23 is surrounded in intimate relation by a plastics material cover 24. One end of the core 23 projects beyond the cover sleeve 24 and has a fitting 25 for connection to a socket 26 (FIG. 2) which is energized with high voltage current from a transformer 27 energized from an alternating current electrical source 28. The trough 17 like the "C" clamps 22 is made of metal and is grounded.

The trough 17 is filled with a dielectric powder P to a level below the open top thereof. The powder is very fine and may be ordinary flour or corn starch capable of dusting the fresh ink on the sheets 12.

The transformer 26 charges the core 23 at about 8–10,000 volts at an amperage of about 3.5. This charging of the core creates an electrostatic field surrounding the electrode in the path of the powder falling from the slot 18 causing the powder particles to disperse to form a very fine spray or mist encompassing the falling sheets 12 and preventing the ink thereon from smudging while also preventing the sheets from sticking together in the stack 13.

Figure 5:
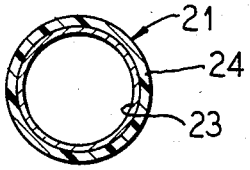
FIG. 5 is a cross-sectional view along the line V—V of FIG. 4.
Figure 4:
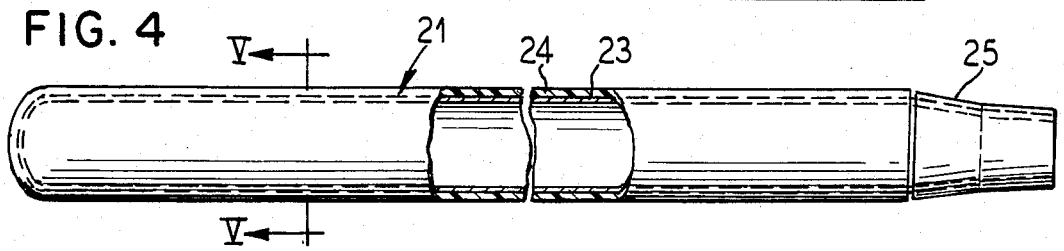
FIG. 4 is an elevational view with parts broken away and shown in cross section, of an electrode of this invention.

As shown in FIGS. 4 and 5, the "oxidizer" tube 21 may have the core 23 thereof in the form of a hollow metal tube with the covering 24 in the form of a sleeve tightly embracing the tube 23 around its full length and over its free end. The other end of the tube receives the electrical connector 25 projecting from the sleeve 24.

The tube 23 need only have a diameter of about 178 inch while the coating 24 need only be about 1/16 of an inch thick. The coating can be applied as a pre-molded sleeve with a tight fit around the core or can be in the form of a molded on coating.

From the above description, it will therefore be understood that this invention provides a so-called "oxidizer" tube for misting or spray devices charging dry dielectric powder to form a cloud embracing freshly printed sheets as they are discharged from a printing press. The oxidizer tube of this invention replaces heretofore required "neon" glass tubes and will last as long as the spray device thereby avoiding heretofore required replacements of oxidizer tubes after a short useful life.

It will be apparent to those skilled in the art that many modifications and variations may be effected without departing from the spirit and scope of the novel concepts of the present invention.

We claim as our invention:

1. In a dry powder sprayer forming a mist of dispersed powder particles for use in printing presses of the type discharging printed sheets successively onto a stack and having an elongated container for dry powder with an outlet spanning the path of the discharging sheets and positioned above the stack and means controlling the feeding of powder through said outlet, the improvement which comprises an elongated electrode in the path of powder discharging from the outlet, said electrode having an electric current conducting core spanning the full length of the electrode and surrounded by a high dielectric plastics material cover, and means for feeding a high voltage current through the length of said core to provide an electrostatic field surrounding the electrode receiving controlled amounts of powder from said outlet.

2. The further improvement of claim 1 comprising clips on the container releasably supporting the electrode in spaced relation from the container.

3. The further improvement of claim 1 wherein said core is metal and said cover is a sheath of high dielectric strength plastics material intimately surrounding the metal core.

4. The further improvement of claim 1 wherein the sheath is composed of a polyetherimide resin.

5. The further improvement of claim 1 wherein the metal core is a thin metal tube and the sheath is thicker than the tube.

* * * * *